US009812054B2

(12) United States Patent
Yang et al.

(10) Patent No.: US 9,812,054 B2
(45) Date of Patent: Nov. 7, 2017

(54) DISPLAY DRIVER AND DISPLAY APPARATUS USING SUB-PIXEL RENDERING METHOD

(71) Applicant: Novatek Microelectronics Corp., Hsinchu (TW)

(72) Inventors: Hsueh-Yen Yang, Taoyuan (TW); Kai-Min Yang, Kaohsiung (TW); Chin-Yuan Tu, Taoyuan (TW); Feng-Ting Pai, Hsinchu (TW)

(73) Assignee: Novatek Microelectronics Corp., Hsinchu (TW)

( * ) Notice: Subject to any disclaimer, the term of this patent is extended or adjusted under 35 U.S.C. 154(b) by 134 days.

(21) Appl. No.: 14/788,805

(22) Filed: Jul. 1, 2015

(65) Prior Publication Data

US 2016/0163286 A1 Jun. 9, 2016

Related U.S. Application Data

(60) Provisional application No. 62/087,815, filed on Dec. 5, 2014.

(30) Foreign Application Priority Data

Feb. 12, 2015 (TW) ..... 104104731

(51) Int. Cl.
*G09G 3/20* (2006.01)

(52) U.S. Cl.
CPC ... *G09G 3/2011* (2013.01); *G09G 2300/0439* (2013.01); *G09G 2300/0452* (2013.01);
(Continued)

(58) Field of Classification Search
CPC ..... G09G 3/2011; G09G 2300/0439; G09G 2300/0452; G09G 2330/021; G09G 2340/0457
See application file for complete search history.

(56) References Cited

U.S. PATENT DOCUMENTS 7,084,923 B2 8/2006 Brown Elliott et al.
7,573,493 B2 8/2009 Brown Elliott et al.
(Continued)

FOREIGN PATENT DOCUMENTS

CN 1871851 11/2006
CN 101009083 8/2007
CN 100510883 7/2009

OTHER PUBLICATIONS

"Office Action of Taiwan Counterpart Application", dated Mar. 24, 2016, p. 1-p. 11.

*Primary Examiner* — Larry Sternbane
(74) *Attorney, Agent, or Firm* — JCIPRNET

(57) ABSTRACT

A display driver configured to drive a display panel is provided. The display panel displays an image frame in a first display mode or a second display mode. The display driver includes a first display driving channel and a second display driving channel. The first and the second display driving channels are configured to drive the display panel to display the image frame by using a sub-pixel rendering method. In the second display mode, the second display driving channel drives sub-pixels on the display panel to display corresponding grayscales by using a plurality of gamma voltages. A voltage value of at least one gamma voltage among the gamma voltages is determined according to an arrangement of the sub-pixels on the display panel. Furthermore, a display apparatus is also provided.

26 Claims, 6 Drawing Sheets

(52) U.S. Cl.
CPC ..... *G09G 2330/021* (2013.01); *G09G 2340/0457* (2013.01)

(56) References Cited

U.S. PATENT DOCUMENTS

| | | | | |
|---|---|---|---|---|
| 7,701,476 | B2 | 4/2010 | Brown Elliott et al. | |
| 8,294,741 | B2 | 10/2012 | Brown Elliott et al. | |
| 2003/0011603 | A1* | 1/2003 | Koyama ..... | G09G 5/24 345/470 |
| 2004/0051724 | A1 | 3/2004 | Elliott et al. | |
| 2005/0099540 | A1 | 5/2005 | Elliott et al. | |
| 2007/0052887 | A1 | 3/2007 | Brown Elliot et al. | |
| 2007/0057963 | A1 | 3/2007 | Brown Elliott et al. | |
| 2008/0231577 | A1 | 9/2008 | Lin et al. | |
| 2010/0164978 | A1 | 7/2010 | Brown Elliott et al. | |
| 2011/0148908 | A1* | 6/2011 | Jeong ..... | G09G 5/02 345/590 |
| 2014/0043357 | A1* | 2/2014 | Yamato ..... | G09G 3/3607 345/603 |

* cited by examiner

DISPLAY DRIVER AND DISPLAY APPARATUS USING SUB-PIXEL RENDERING METHOD

CROSS-REFERENCE TO RELATED APPLICATION

This application claims the priority benefits of U.S. provisional application Ser. No. 62/087,815, filed on Dec. 5, 2014 and Taiwan application serial no. 104104731, filed on Feb. 12, 2015. The entirety of each of the above-mentioned patent applications is hereby incorporated by reference herein and made a part of this specification.

BACKGROUND OF THE INVENTION

Field of the Invention

The invention relates to an electronic apparatus and a driver of the electronic apparatus, and more particularly, to a display apparatus and a display driver.

Description of Related Art

With the blooming development in display technology, the market demands for performance requirements of a display panel are advancements in high resolution, high brightness and low-power consumption. However, with increases in a resolution of the display panel, because the amount of sub-pixels on the display panel also increases in order to display in high resolution, the manufacturing cost is also increased accordingly. In order to reduce the manufacturing cost of the display panel, a sub-pixel rendering method has been developed. A display apparatus generally uses different arrangements and designs of the sub-pixels to formulate a proper algorithm so that the resolution may be increased to a sub-pixel resolution when an image is displayed. Because the size of the sub-pixel is smaller than that of a pixel, the resolution that is visible by human eye (i.e., a visual resolution) may be increased. Further, from the perspective of low-power consumption, the display apparatus may also operate in a low-power mode based on requirements in practical applications. In the low-power mode, a more preferable user experience may be provided if the display apparatus is capable of continuously providing a favorable display quality.

SUMMARY OF THE INVENTION

The invention provides a display driver and a display apparatus, which are capable of taking into account both display quality and power-saving.

A display driver of the invention is configured to drive a display panel. The display panel is configured to display an image frame in a first display mode or a second display mode. The display driver includes a first display driving channel and a second display driving channel. The first display driving channel drives the display panel to display the image frame by using a sub-pixel rendering method in the first display mode. The second display driving channel drives the display panel to display the image frame by using the sub-pixel rendering method in the second display mode. The display panel includes a sub-pixel repeating unit. The sub-pixel repeating unit is repeatedly arranged to form the display panel. The sub-pixel repeating unit includes a plurality of pixel units. Each of the pixel units includes one to two sub-pixels. In the second display mode, the second display driving channel drives the sub-pixels on the display panel to display corresponding grayscales by using a plurality of gamma voltages. A voltage value of at least one gamma voltage among the gamma voltages is determined according to an arrangement of the sub-pixels on the display panel.

A display apparatus of the invention includes a display panel and a display driver. The display panel includes a sub-pixel repeating unit. The sub-pixel repeating unit is repeatedly arranged to form the display panel. The sub-pixel repeating unit includes a plurality of pixel units. Each of the pixel units includes one to two sub-pixels. The display panel is configured to display an image frame in a first display mode or a second display mode. The display driver is coupled to the display panel. The display driver includes a first display driving channel and a second display driving channel, and is configured to drive the display panel to display the image frame by using a sub-pixel rendering method. In the second display mode, the second display driving channel drives sub-pixels on the display panel to display corresponding grayscales by using a plurality of gamma voltages. A voltage value of at least one gamma voltage among the gamma voltages is determined according to an arrangement of the sub-pixels on the display panel.

According to an embodiment of the invention, in the display panel, each of the pixel units includes at least one of a first color sub-pixel, a second color sub-pixel and a third color sub-pixel. A voltage value of the at least one gamma voltage among the gamma voltages is determined according to at least one ratio relationship. The at least one ratio relationship is determined according to a first quantity ratio in a first direction and a second quantity ratio in a second direction occupied by the at least one of the first color sub-pixel, the second color sub-pixel and the third color sub-pixel in the sub-pixel repeating unit, on the basis of pixel units.

According to an embodiment of the invention, in the display panel, the pixel units include a first pixel unit and a second pixel unit. The first color sub-pixel and the second color sub-pixel are adjacently arranged to form the first pixel unit. The third color sub-pixel and the second color sub-pixel are adjacently arranged to form the second pixel unit.

According to an embodiment of the invention, in the display panel, the pixel units include a first pixel unit, a second pixel unit and a third pixel unit. The first color sub-pixel and the second color sub-pixel are adjacently arranged to form the first pixel unit. The third color sub-pixel and the second color sub-pixel are adjacently arranged to form the second pixel unit. The first color sub-pixel and the third color sub-pixel are adjacently arranged to form the third pixel unit.

According to an embodiment of the invention, in the display panel, the first color sub-pixel, the second color sub-pixel and the third color sub-pixel are adjacently arranged to form two pixel units among the pixel units.

According to an embodiment of the invention, in the display panel, each of the pixel units includes a single sub-pixel. The single sub-pixel includes the first color sub-pixel, the second color sub-pixel and the third color sub-pixel.

According to an embodiment of the invention, in the display panel, the first color sub-pixel, the second color sub-pixel and the third color sub-pixel are a red sub-pixel, a green sub-pixel and a blue sub-pixel respectively.

According to an embodiment of the invention, the sub-pixel includes a target driving sub-pixel. The second display driving channel determines whether to drive the target driving sub-pixel by using the at least one determined gamma voltage according to an edge relationship between the target driving sub-pixel and a plurality of the sub-pixels adjacent thereto in the second display mode.

According to an embodiment of the invention, the second display driving channel determines the edge relationship according to a most significant bit of sub-pixel data written in the target driving sub-pixel and the sub-pixels adjacent thereto.

According to an embodiment of the invention, the second display driving channel includes a data processing unit and a voltage output unit. The data processing unit is configured to determine the edge relationship according to the most significant bit of the sub-pixel data written in the target driving sub-pixel and the sub-pixels adjacent thereto. The voltage output unit is coupled to the data processing unit. The voltage output unit is configured to determine whether to drive the target driving sub-pixel by using the at least one determined gamma voltage according to the edge relationship between the target driving sub-pixel and the sub-pixels adjacent thereto.

According to an embodiment of the invention, the gamma voltages include a first gamma voltage, a second gamma voltage and a third gamma voltage. A voltage value of the third gamma voltage is determined according to the arrangement of the sub-pixels on the display panel. A voltage value of the first gamma voltage is less than a voltage value of the second gamma voltage. The voltage value of the third gamma voltage falls between the voltage values of the first gamma voltage and the second gamma voltage.

According to an embodiment of the invention, the gamma voltages further include a fourth gamma voltage. A voltage value of the fourth gamma voltage is further determined according to the arrangement of the sub-pixels on the display panel. The voltage value of the fourth gamma voltage falls between the voltage values of the first gamma voltage and the third gamma voltage.

According to an embodiment of the invention, the first display driving channel drives the display panel by using the first gamma voltage and the second gamma voltage in the first display mode.

According to an embodiment of the invention, the display driver further includes a selection unit. The selection unit selects to drive the display panel to display the image frame in the first display mode or the second display mode by using the first display driving channel or the second display driving channel according to a selection signal.

Based on the above, in the exemplary embodiments of the invention, when the display driver drives the sub-pixels to display the corresponding grayscales by using the gamma voltage determined according to the arrangement of the sub-pixels on the display panel both display quality and power-saving can be taken into account.

To make the above features and advantages of the invention more comprehensible, several embodiments accompanied with drawings are described in detail as follows.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

Figure 1:
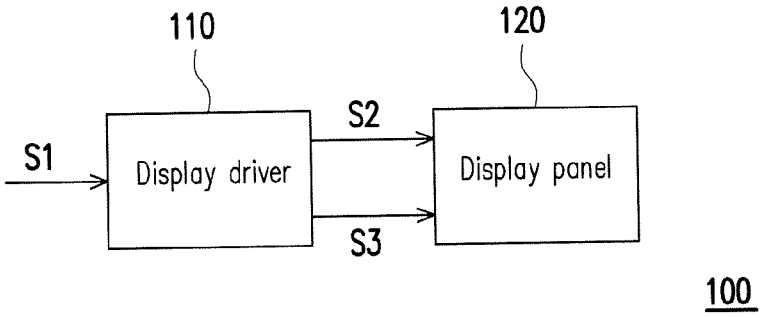
FIG. 1 is a schematic diagram illustrating a display apparatus according to an embodiment of the invention.

Reference will now be made in detail to the present preferred embodiments of the invention, examples of which are illustrated in the accompanying drawings. Wherever possible, the same reference numbers are used in the drawings and the description to refer to the same or like parts.

Figure 2:
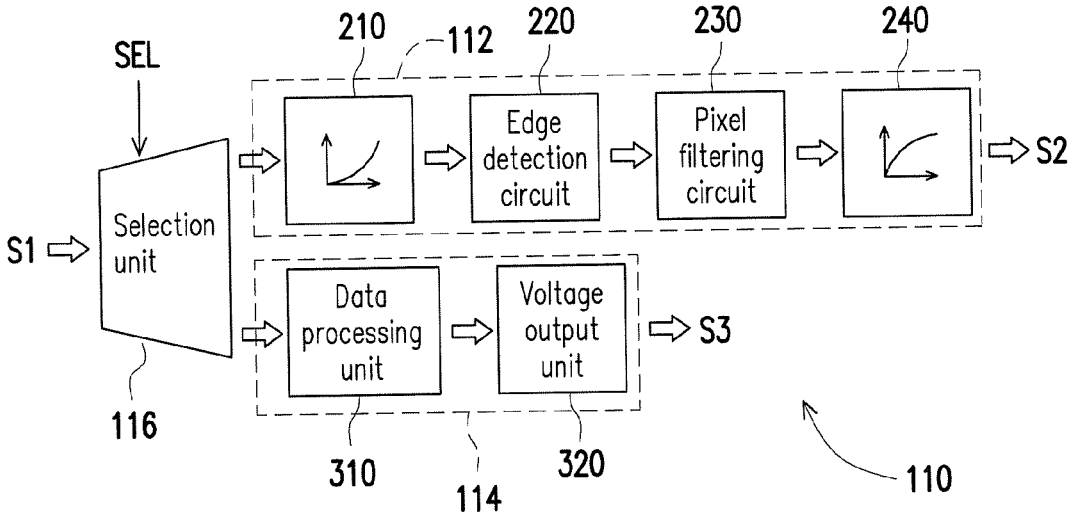
FIG. 2 is a schematic diagram illustrating a circuitry block inside a display driver in the embodiment of FIG. 1.

FIG. 1 is a schematic diagram illustrating a display apparatus according to an embodiment of the invention. FIG. 2 is a schematic diagram illustrating a circuitry block inside a display driver in the embodiment of FIG. 1. Referring to FIG. 1 and FIG. 2, a display apparatus 100 of the present embodiment includes a display driver 110 and a display panel 120. The display driver 110 is coupled to the display panel 120. The display driver 110 is configured to receive display data S1, and outputs driving signals S2 or S3 to the display panel 120 after performing a data processing on the display data S1, so as to drive the display panel 120 to display an image frame in a first display mode or a second display mode by using a sub-pixel rendering method. In the present embodiment, the second display mode is, for example, a low-power mode in a power-saving application. In contrast, the first display mode is, for example, a normal mode in a non power-saving application.

Specifically, in the present embodiment, the display driver 110 includes a first display driving channel 112, a second display driving channel 114 and a selection unit 116. The selection unit 116 is configured to select the first display driving channel 112 or the second display driving channel 114 to perform the data processing on the display data S1 according to a selection signal SEL. The first display driving channel 112 and the second display driving channel 144 output the driving signals S2 and S3 respectively, so that the display driver 110 may drive the display panel 120 to display the image frame in the first display mode or the second display mode.

In the present embodiment, the selection signal SEL is, for example, configured to select a signal transmission path for connecting to the second display driving channel 114 so that the display driver 110 may drive the display panel 120 by using the second display driving channel 114 when the display apparatus 100 needs to enter the low-power mode. In the present embodiment, a possible situation where the display apparatus 100 may require to enter the low-power mode includes, but not limited to, when the display apparatus 100 is in a standby state because it is not required to display a full image frame for a long period of time, or when users intend to set the display apparatus 100 to enter the low-power mode based on requirements in practical operation, or when an electric power of a power-supply unit for providing power to the display apparatus 100 is almost empty, or other possible situations when entering the low-power mode is required. It is possible that the display apparatus 110 will enter the low-power mode in at least three of aforesaid situations. Accordingly, the display driver 110 drives the display panel 120 by using the second display driving channel 114.

In the present embodiment, the first display driving channel 112 drives the display panel 120 to display the image frame by using the sub-pixel rendering method in the first display mode. Specifically, the first display driving channel 112 of the present embodiment includes a first voltage converter 210, an edge detection circuit 220, a pixel filtering circuit 230 and a second voltage converter 240. In one exemplary embodiment, the first voltage converter 210, the edge detection circuit 220, the pixel filtering circuit 230, and the second voltage converter 240 may, for example, be implemented by application-specific integrated circuits (ASIC) or field programmable gate arrays (FPGA), but the invention is not limited thereto.

In the first display mode, the first voltage converter 210 performs, for example, a gamma-to-linear conversion on a nonlinear gamma image signal of the display data S1 so as to convert the nonlinear gamma image signal into a linear signal. Next, the edge detection circuit 220 performs an edge detection on image frame information included in the linear signal. Subsequently, the pixel filtering circuit 230 performs a filtering operation on edge information of the image frame so as to improve a quality of the image frame to be displayed. Thereafter, the second voltage converter 240 performs a linear-to-gamma conversion on the linear signal on which the filtering operation is performed, so as to convert such linear signal into a nonlinear gamma voltage for outputting the driving signal S2 to drive the display panel 120 in the first display mode.

Therefore, in the first display mode, the first display driving channel 112 drives the display panel 120 by using, for example, a plurality of preset gamma voltages. For instance, in an embodiment, the first display driving channel 112 drives a plurality of sub-pixels on the display panel 120 to display corresponding grayscales by using, for example, gamma voltages V0, V255 and other preset gamma voltages in the first display mode.

In the present embodiment, the second display driving channel 114 drives the display panel 120 to display the image frame by using the sub-pixel rendering method in the second display mode. Specifically, the second display driving channel 114 includes a data processing unit 310 and a voltage output unit 320. The voltage output unit 320 is coupled to the data processing unit 310. In one exemplary embodiment, the data processing unit 310 may, for example, include a central processing unit (CPU), a microprocessor, a digital signal processor (DSP), a programmable controller, a programmable logic device (PLD) or other similar devices or a combination of the above devices. The voltage output unit 320 may include an output buffer for receiving the output of the data processing unit 310 and outputting the driving signal S3.

In the second display mode, the voltage output unit 320 drives the display panel 120 by using a plurality of gamma voltages. In the present embodiment, a voltage value of at least one gamma voltage among the gamma voltages for driving the display panel 120 is determined according to an arrangement of the sub-pixels on the display panel 120. For instance, in the present embodiment, the arrangement of the sub-pixels may be evaluated by at least one ratio relationship related to the arrangement of the sub-pixels, for example. The ratio relationship is, for example, determined according to the arrangement of the sub-pixels in different colors on the display panel 120 in different directions. Therefore, in the present embodiment, the voltage value of the at least one gamma voltage among the gamma voltages for driving the display panel 120 may be determined according to said ratio relationship, for example.

For instance, in an embodiment, the voltage output unit 320 drives the sub-pixels on the display panel 120 to display the corresponding grayscales by using, for example, gamma voltages V0, V186 and V255 in the second display mode. In this example, the gamma voltage V186 is, for example, determined according to the arrangement of the sub-pixels on the display panel 120, and the determined gamma voltage V186 falls between the gamma voltages V0 and V255. In other words, the gamma voltage V186 being an intermediate voltage between the two is determined based on the ratio relationship of the sub-pixels on the panel and configured to satisfy a demand for a color compensation on the sub-pixels arranged on the edges. In another embodiment, the voltage output unit 320 drives the sub-pixels on the display panel 120 to display the corresponding grayscales by using, for example, gamma voltages V0, V155, V212 and V255 in the second display mode. In this example, the gamma voltages V155 and V212 are, for example, determined according to the arrangement of the sub-pixels on the display panel 120, and the determined gamma voltages V155 and V212 fall between the gamma voltages V0 and V255. In the present embodiment, compared to the second display mode, the gamma voltages V0, V255 and the other preset gamma voltages for driving the display panel 120 are predetermined in the first display mode rather than being adjusted according to the ratio relationship related to the arrangement of the sub-pixels on the display panel 120. In other words, a minimum grayscale and a maximum grayscale of the display panel 120 are determined by the gamma voltages V0 and V255.

It should be noted that, although the present embodiment is described by using the display driver 110 which includes the two display driving channels as an example, the invention is not limited thereto. In an embodiment, a driving function of the second display driving channel 114 may also be realized as an integration with any circuitry block in the first display driving channel 112. Alternatively, the driving function of the second display driving channel 114 may also be realized as a circuitry block newly-added to the first display driving channel 112.

Embodiments are provided below to describe a method of the second display driving channel 114 for determining the gamma voltages, but the invention is not limited to the provided embodiments, and the provided embodiments can be suitably combined.

Figure 3:
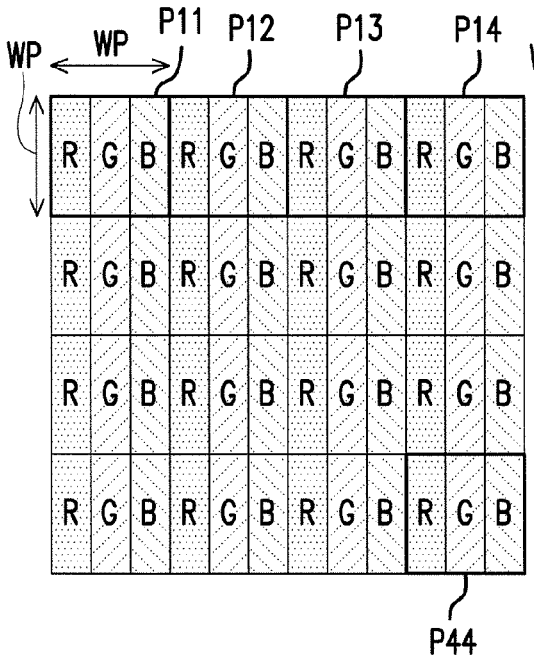
FIG. 3, FIG. 7, FIG. 11 and FIG. 15 are schematic diagrams respectively illustrating parts of pixel data according different embodiments of the invention.
Figure 4:
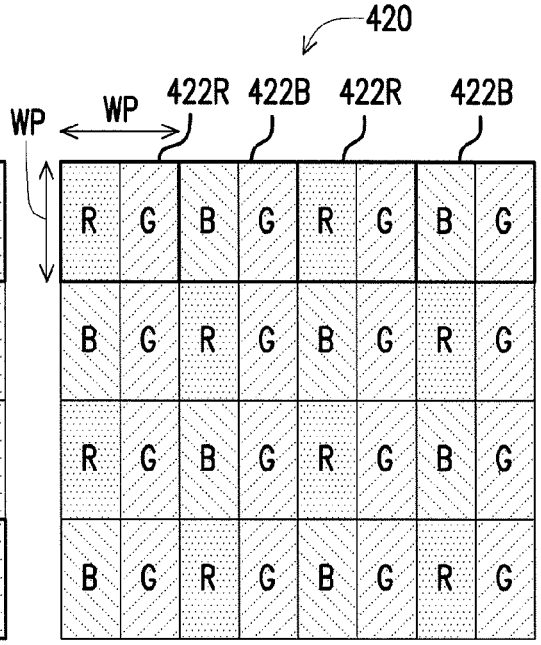
FIG. 4, FIG. 8, FIG. 12 and FIG. 16 are schematic diagrams respectively illustrating parts of the sub-pixels on the display panel according different embodiments of the invention.
Figure 5:
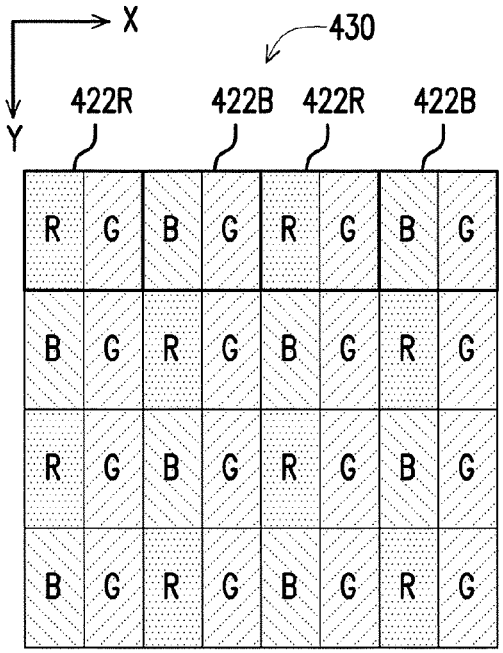
FIG. 5, FIG. 9, FIG. 13 and FIG. 17 are schematic diagrams respectively illustrating a sub-pixel repeating unit according different embodiments of the invention.

FIG. 3 is a schematic diagram illustrating parts of pixel data according an embodiment of the invention. FIG. 4 is a schematic diagram illustrating parts of the sub-pixels on the display panel according an embodiment of the invention. FIG. 5 is a schematic diagram illustrating a sub-pixel repeating unit according an embodiment of the invention.

Referring to FIG. 1 to FIG. 5, in the present embodiment, what illustrated in FIG. 3 is, for example, the display data S1 inputted to the display driver 110 in FIG. 1, and the display data S1 includes a plurality of pixel data P11 to P44 to be written into a plurality of pixel units (422R, 422B) on a display panel 420, respectively. In the present embodiment, each of the pixel data P11 to P44 includes a first color sub-pixel data, a second color sub-pixel data and a third color sub-pixel data. Furthermore, in the present embodiment, although it is illustrated with only sixteen pixel data P11 to P44 in FIG. 3 as an example, such quantity is not intended to limit the invention. In the present embodiment, the display panel 420 includes the pixel units (422R, 422B), and each of the pixel units (422R, 422B) includes two sub-pixels. Said two sub-pixels are, for example, two color sub-pixels selected from a first color sub-pixel, a second color sub-pixel and a third color sub-pixel. For instance, in the present embodiment, the first color sub-pixel, the second color sub-pixel and the third color sub-pixel are, a red sub-pixel, a green sub-pixel and a blue sub-pixel respectively, but the invention is not limited thereto. In an embodiment, the first color sub-pixel, the second color sub-pixel and the third color sub-pixel may be a combination of a white sub-pixel and the other sub-pixels in different colors. In the present embodiment, the pixel unit 422R includes, for example, the red sub-pixel and the green sub-pixel, and the pixel unit 422B includes, for example, the blue sub-pixel and the green sub-pixel. The two pixel units 422R and 422B including the sub-pixels in different colors are arranged in staggered arrangement on the display panel 420 in different directions, so as to form a sub-pixel array. In the present embodiment, each of the pixel units (422R, 422B) includes two sub-pixels.

In the present embodiment, the display driver 110 writes the pixel data P11 into the pixel unit 422R, for example, and the pixel data P11 and the pixel unit 422R both include one pixel width (WP) in both a X direction and a Y direction. In the present embodiment, because the pixel unit 422R only includes the red sub-pixel and the green sub-pixel, the display driver 110 drives the display panel 420 to display the image frame by using the sub-pixel rendering method. In the sub-pixel rendering method, in order to display the pixel data P11 having red, blue and green, the pixel unit 422R which only includes the red sub-pixel and the green sub-pixel may at least cooperate with the pixel units 422B adjacent thereto to compensate its lacking of the blue sub-pixel, so as to collaboratively display the pixel data P11. Similarly, in the sub-pixel rendering method, in order to display the pixel data P12 having red, blue and green, the pixel unit 422B which only includes the blue sub-pixel and the green sub-pixel may at least cooperate with the pixel units 422R adjacent to the left or the right to compensate its lacking of the red sub-pixel, so as to collaboratively display the pixel data P12. This kind of method which uses the adjacent pixel units to collaboratively display the same pixel data may be regarded as the sub-pixel rendering method, but the invention is not limited thereto. In other embodiments, it is also possible that various modifications may be made to the driving method of the display driver 110 for driving the display panel 420 to display the image frame by using the sub-pixel rendering method.

Hereinafter, referring to FIG. 5, in the present embodiment, parts of the sub-pixels of the display panel 420 are arranged into an array to form a sub-pixel repeating unit 430 of FIG. 5. The sub-pixel repeating unit 430 is repeatedly arranged to form the sub-pixel array of the display panel 420. In the present embodiment, the sub-pixel repeating unit 430 is, for example, a pixel array of 4×4 formed by arranging a plurality of the pixel units (422R, 422B) together. In the present embodiment, apart from the gamma voltages V0 and V255, the voltage output unit 320 further drives the sub-pixels on the display panel 420 by using, for example a gamma voltage V186 in the second display mode. In the present embodiment, the gamma voltage V186 is, for example, determined according to at least one ratio relationship. The ratio relationship is determined according to a first quantity ratio in the X direction (a horizontal sub-pixel ratio) and a second quantity ratio in the Y direction (a vertical sub-pixel ratio) occupied by the pixel units (422R, 422B) in the sub-pixel repeating unit 430, on the basis of pixel units. For instance, take the red sub-pixel for example, in a first row of the sub-pixel repeating unit 430, in terms of quantity ratio, the pixel unit 422R has the first quantity ratio of 1/2 on the same row in the X direction. In other words, on the basis of pixel units, because the pixel unit 422R having the red sub-pixel occupies two over four of the pixel units (422R, 422B) of the first row, the first quantity ratio is 1/2. Because each pixel row in the Y direction includes the pixel unit 422R, in terms of quantity ratio, the pixel unit 422R has the second quantity ratio of 1/1 in the Y direction. In other words, in the sub-pixel repeating unit 430, on the basis of pixel units, because each row includes the pixel unit 422R having the red sub-pixel, the second quantity ratio is 1/1. Therefore, the ratio relationship determined according to the red sub-pixel is (1/2)/(1/1)=1/2. Similarly, take the blue sub-pixel for example, in the sub-pixel repeating unit 430, the pixel unit 422B has the first quantity ratio of 1/2 on the same row in the X direction. Because each pixel row in the Y direction includes the pixel unit 422B, the pixel unit 422B has the second quantity ratio of 1/1 in the Y direction. Therefore, the ratio relationship determined according to the blue sub-pixel is (1/2)/(1/1)=1/2. In addition, take the green sub-pixel for example, in the sub-pixel repeating unit 430, because each of the pixel units (422B, 422R) includes the green sub-pixel, each of the pixel units (422B, 422R) has the first quantity ratio of 1/1 on the same row in the X direction and has the second quantity ratio of 1/1 on the same column in the Y direction. Therefore, the ratio relationship determined according to the green sub-pixel is (1/1)/(1/1)=1/1. In the present embodiment, the gamma voltage V186 is, for example, determined according to the ratio relationship of 1/2 together with a preset gamma voltage curve, and configured to drive the red and blue sub-pixels on the display panel 420.

After the voltage value of the gamma voltage V186 is determined according to the arrangement of the sub-pixels on the display panel 420, the voltage output unit 320 determines whether to drive a target driving sub-pixel by using the determined gamma voltage V186 according to an edge relationship between the target driving sub-pixel and a plurality of the sub-pixels adjacent thereto. For instance, in the present embodiment, in the case where the target driving sub-pixel is the blue sub-pixel of the pixel unit 422B in FIG. 4, the data processing unit 310 determines the edge relationship between the sub-pixels according to a most significant bit of the sub-pixel data written in the target driving sub-pixel and the sub-pixels adjacent thereto. Take the blue sub-pixel data in the pixel data P11, P12 and P13 for example, the data processing unit 310 may fetch the most significant bit of the blue sub-pixel data so as to determine the edge relationship between the blue sub-pixels. If a sequence of the most significant bit of the blue sub-pixel data fetched by the data processing unit 310 is 010, in this example, the voltage output unit 320 may determine to drive the blue sub-pixel of the pixel unit 422B by using the gamma voltage V186. In addition, in the present embodiment, in the case where the sequence of the most significant bit of the blue sub-pixel data fetched by the data processing unit 310 is 011, 100 or 101, the voltage output unit 320 may also determine to drive the blue sub-pixel of the pixel unit 422B by using the gamma voltage V 186. In the present embodiment, if the sequence the most significant bit of the blue sub-pixel data is 000, 001, 110 or 111, the voltage output unit 320 drives the blue sub-pixel of the pixel unit 422B by using, for example, the gamma voltage V0 or V255. Similarly, in the present embodiment, if the target driving sub-pixel is the red sub-pixel of the pixel unit 422R, whether the voltage output unit 320 uses the gamma voltage V186 for driving may also be determined by aforementioned determination method, which is not repeated hereinafter. In addition, in the present embodiment, the green sub-pixel is, for example, driven by the gamma voltage V0 or V255.

Accordingly, in the present embodiment, the voltage output unit 320 may be built-in with a look-up table, in which correspondence relationships between the sequences of the most significant bits and the gamma voltages are listed. The voltage output unit 320 may determine which one of the gamma voltages is to be used in correspondence to the corresponding edge relationship to drive the sub-pixel according to the look-up table.

Figure 6:
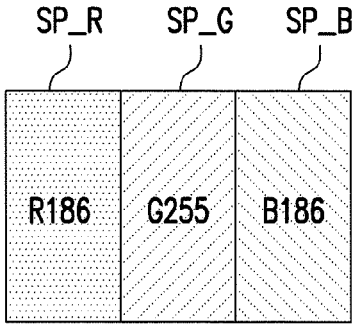
FIG. 6, FIG. 10, FIG. 14 and FIG. 18 are schematic diagrams respectively illustrating a sub-pixel combination for displaying a white point according different embodiments of the invention.

FIG. 6 is a schematic diagram illustrating a sub-pixel combination for displaying a white point according an embodiment of the invention. In the present embodiment, the display panel 420 displays one white point by using a sub-pixel combination including one red sub-pixel SP_R, one green sub-pixel SP_G and one blue sub-pixel SP_B, for example. In FIG. 6, "R186" marked inside the red sub-pixel SP_R indicates that the red sub-pixel SP_R is driven by the gamma voltage V186 and displays in red. "G255" marked inside the green sub-pixel SP_G indicates that the green sub-pixel SP_G is driven by the gamma voltage V255 and displays in green. "B186" marked inside the blue sub-pixel SP_B indicates that the blue sub-pixel SP_B is driven by the gamma voltage V186 and displays in blue. One red sub-pixel SP_R, one green sub-pixel SP_G and one blue sub-pixel SP_B cooperate to display one white point in the second display mode.

Figure 7:
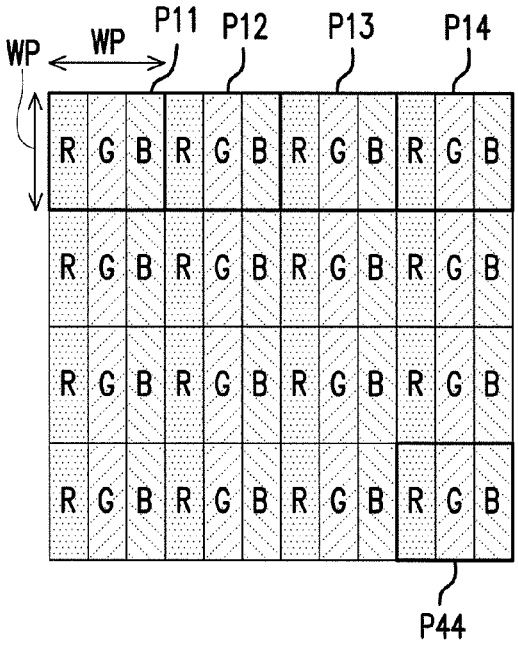
Figure 8:
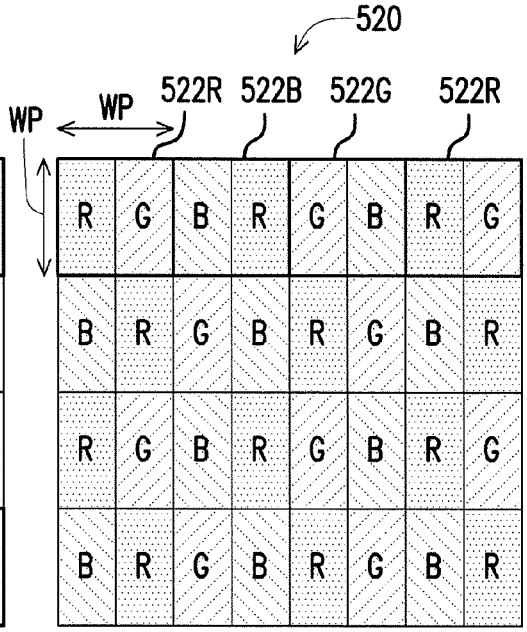
Figure 9:
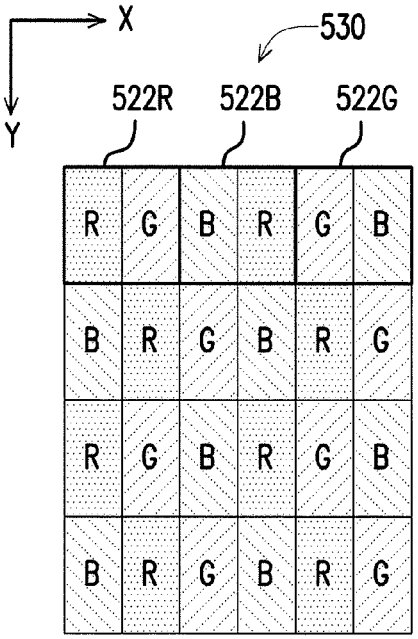

FIG. 7 is a schematic diagram illustrating parts of pixel data according another embodiment of the invention. FIG. 8 is a schematic diagram illustrating parts of the sub-pixels on the display panel according another embodiment of the invention. FIG. 9 is a schematic diagram illustrating a sub-pixel repeating unit according another embodiment of the invention. Referring to FIG. 7 to FIG. 9, a display panel 520 of the present embodiment is similar to the display panel 420 in the embodiment of FIG. 4, and a major difference between the two is that, for example, an arrangement of the sub-pixels on the display panel 520 and component elements of a sub-pixel repeating unit 530.

Specifically, in the present embodiment, the display panel 520 includes a plurality of pixel units (522R, 522G, 522B), and each of the pixel units (522R, 522G, 522B) includes two sub-pixels. For instance, in the present embodiment, the pixel unit 522R includes, for example, the red sub-pixel and the green sub-pixel; the pixel unit 522B includes, for example, the blue sub-pixel and the red sub-pixel; and the pixel unit 522G includes, for example, the green sub-pixel and the blue sub-pixel. The three pixel units 522R, 522G and 522B including the sub-pixels in different colors are arranged in staggered arrangement on the display panel 520 in different directions, so as to form a sub-pixel array. In the present embodiment, each of the pixel units (522R, 522G, 522B) includes two sub-pixels.

In the present embodiment, parts of the sub-pixels of the display panel 520 are arranged into an array to form a sub-pixel repeating unit 530 of FIG. 9. The sub-pixel repeating unit 530 is repeatedly arranged to form the sub-pixel array of the display panel 520. In the present embodiment, the sub-pixel repeating unit 530 is, for example, a pixel array of 3×4 formed by arranging a plurality of the pixel units (522R, 522G, 522B) together. In the present embodiment, apart from the gamma voltages V0 and V255, the voltage output unit 320 further drives the sub-pixels on the display panel 520 by using, for example, a gamma voltage V212 in the second display mode. In the present embodiment, the gamma voltage V212 is, for example, determined according to a first quantity ratio in the X direction (the horizontal sub-pixel ratio) and a second quantity ratio in the Y direction (the vertical sub-pixel ratio) occupied by the pixel units (522R, 522G, 522B) in the sub-pixel repeating unit 530. For instance, take the red sub-pixel for example, in a first row of the sub-pixel repeating unit 530, the pixel units 522R and 522B both include the red sub-pixel, and in terms of quantity ratio, each of the pixel units 522R and 522B has the first quantity ratio of 2/3 on the same row in the X direction. In other words, on the basis of pixel units, because the pixel units 522R and 522B having the red sub-pixel occupies two over three of the pixel units (522R, 522G and 522B) of the first row, the first quantity ratio is 2/3. Because each row in the Y direction includes the pixel units (522R, 522B) having the red sub-pixel, in terms of quantity ratio, each of the pixel unit 522R and 522B has a ratio of 1/1 in the Y direction. In other words, on the basis of pixel units, in the sub-pixel repeating unit 530, because each row includes the pixel units 522R and 522B having the red sub-pixel, the ratio is 1/1. Therefore, the ratio relationship determined according to the red sub-pixel is (2/3)(1/1)=2/3. Similarly, the ratio relationships determined according to the blue sub-pixel and the green sub-pixel are both 2/3. In the present embodiment, the gamma voltage V212 is, for example, determined according to the ratio relationship of 2/3 together with a preset gamma voltage curve, and configured to drive the red, green and blue sub-pixels on the display panel 520.

In the present embodiment, apart from the gamma voltages V0, V212 and V255, the voltage output unit 320 further drives the sub-pixels on the display panel 520 by using, for example, a gamma voltage V155 in the second display mode. In the present embodiment, a voltage value of the gamma voltage V155 falls between the gamma voltages V0 and V212. Specifically, after the gamma voltage V212 is determined according to the ratio relationship of 2/3 together with the gamma voltage curve, a ratio relationship of 1/3 may be obtained from the ratio relationship of 2/3 divided by 2. The gamma voltage V155 is, for example, determined according to the ratio relationship of 1/3 together with a preset gamma voltage curve, and configured to drive the red, green and blue sub-pixels on the display panel 520. In other words, the gamma voltage V155 is also determined according to the arrangement of the sub-pixels on the display panel 520.

After the voltage values of the gamma voltages V155 and V212 are determined according to the arrangement of the sub-pixels on the display panel 520, the voltage output unit 320 determines whether to drive a target driving sub-pixel by using the determined gamma voltage V155 or V212 according to an edge relationship between the target driving sub-pixel and a plurality of the sub-pixels adjacent thereto. For instance, in the present embodiment, in the case where the target driving sub-pixel is the blue sub-pixel of the pixel unit 522B in FIG. 8, the data processing unit 310 determines the edge relationship between the sub-pixels according to a most significant bit of the sub-pixel data written in the target driving sub-pixel and the sub-pixels adjacent thereto. Take the blue sub-pixel data in the pixel data P11, P12 and P13 for example, the data processing unit 310 may fetch the most significant bit of the blue sub-pixel data so as to determine the edge relationship between the blue sub-pixels. If a sequence of the most significant bit of the blue sub-pixel data fetched by the data processing unit 310 is 010, in this example, the voltage output unit 320 may determine to drive the blue sub-pixel of the pixel unit 522B by using the gamma voltage V212. If a sequence of the most significant bit of the blue sub-pixel data fetched by the data processing unit 310 is 100 or 101, in this example, the voltage output unit 320 may determine to drive the blue sub-pixel of the pixel unit 522B by using the gamma voltage V155.

Furthermore, in the present embodiment, in the case where the target driving sub-pixel is the red sub-pixel of the pixel unit 522B in FIG. 8, the data processing unit 310 fetches a most significant bit of the red sub-pixel data in the pixel data P11, P12 and P13, so as to determine the edge relationship between the red sub-pixels. If a sequence of the most significant bit of the red sub-pixel data fetched by the data processing unit 310 is 010 or 110, in this example, the voltage output unit 320 may determine to drive the red sub-pixel of the pixel unit 522B by using the gamma voltage V212. If a sequence of the most significant bit of the red sub-pixel data fetched by the data processing unit 310 is 001 or 101, in this example, the voltage output unit 320 may determine to drive the red sub-pixel of the pixel unit 522B by using the gamma voltage V155.

Similarly, in the present embodiment, if the target driving sub-pixel is the green sub-pixel of the pixel unit 522G, whether the voltage output unit 320 uses the gamma voltage V155 or V212 for driving may also be determined by aforementioned determination method. For instance, in the case where a sequence of the most significant bit of the green sub-pixel data fetched by the data processing unit 310 is 010, the voltage output unit 320 may determine to drive the green sub-pixel of the pixel unit 522G by using the gamma voltage V212. If a sequence of the most significant bit of the green sub-pixel data fetched by the data processing unit 310 is 100 or 101, in this example, the voltage output unit 320 may determine to drive the green sub-pixel of the pixel unit 522G by using the gamma voltage V155. Further, in the present embodiment, if the target driving sub-pixel is the blue sub-pixel of the pixel unit 522G, whether the voltage output unit 320 uses the gamma voltage V155 or V212 for driving may also be determined by aforementioned determination method. For instance, in the case where a sequence of the most significant bit of the blue sub-pixel data fetched by the data processing unit 310 is 010 or 110, in this example, the voltage output unit 320 may determine to drive the blue sub-pixel of the pixel unit 522G by using the gamma voltage V212. If a sequence of the most significant bit of the blue sub-pixel data fetched by the data processing unit 310 is 001 or 101, in this example, the voltage output unit 320 may determine to drive the blue sub-pixel of the pixel unit 522G by using the gamma voltage V155.

Similarly, in the present embodiment, if the target driving sub-pixel is the red sub-pixel of the pixel unit 522R, whether the voltage output unit 320 uses the gamma voltage V155 or V212 for driving may also be determined by aforementioned determination method. For instance, in the case where a sequence of the most significant bit of the red sub-pixel data fetched by the data processing unit 310 is 010, in this example, the voltage output unit 320 may determine to drive the red sub-pixel of the pixel unit 522R by using the gamma voltage V212. If a sequence of the most significant bit of the red sub-pixel data fetched by the data processing unit 310 is 100 or 101, in this example, the voltage output unit 320 may determine to drive the red sub-pixel of the pixel unit 522R by using the gamma voltage V155. Further, in the present embodiment, if the target driving sub-pixel is the green sub-pixel of the pixel unit 522R, whether the voltage output unit 320 uses the gamma voltage V155 or V212 for driving may also be determined by aforementioned determination method. For instance, in the case where a sequence of the most significant bit of the green sub-pixel data fetched by the data processing unit 310 is 010 or 110, in this example, the voltage output unit 320 may determine to drive the green sub-pixel of the pixel unit 522R by using the gamma voltage V212. If a sequence of the most significant bit of the green sub-pixel data fetched by the data processing unit 310 is 001 or 101, in this example, the voltage output unit 320 may determine to drive the green sub-pixel of the pixel unit 522R by using the gamma voltage V155.

Figure 10:
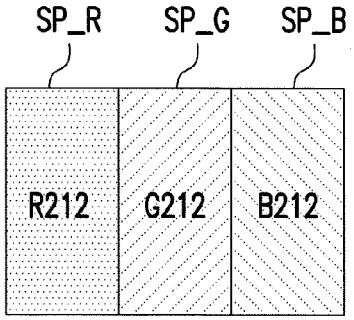

FIG. 10 is a schematic diagram illustrating a sub-pixel combination for displaying a white point according another embodiment of the invention. In the present embodiment, the display panel 520 displays one white point by using a sub-pixel combination including one red sub-pixel SP_R, one green sub-pixel SP_G and one blue sub-pixel SP_B, for example. In FIG. 10, "R212" marked inside the red sub-pixel SP_R indicates that the red sub-pixel SP_R is driven by the gamma voltage V212 and displays in red. "G212" marked inside the green sub-pixel SP_G indicates that the green sub-pixel SP_G is driven by the gamma voltage V212 and displays in green. "B212" marked inside the blue sub-pixel SP_B indicates that the blue sub-pixel SP_B is driven by the gamma voltage V212 and displays in blue. One red sub-pixel SP_R, one green sub-pixel SP_G and one blue sub-pixel SP_B cooperate to display one white point in the second display mode.

Figure 11:
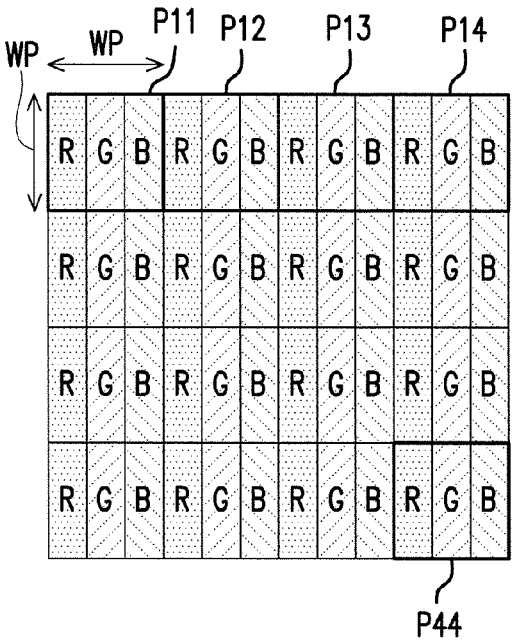
Figure 12:
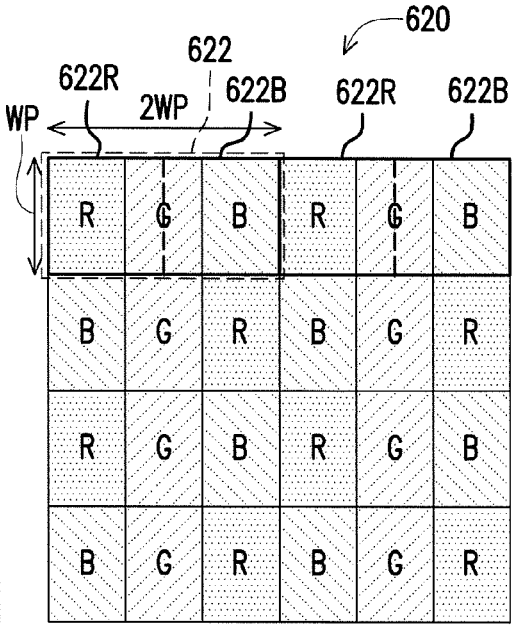
Figure 13:
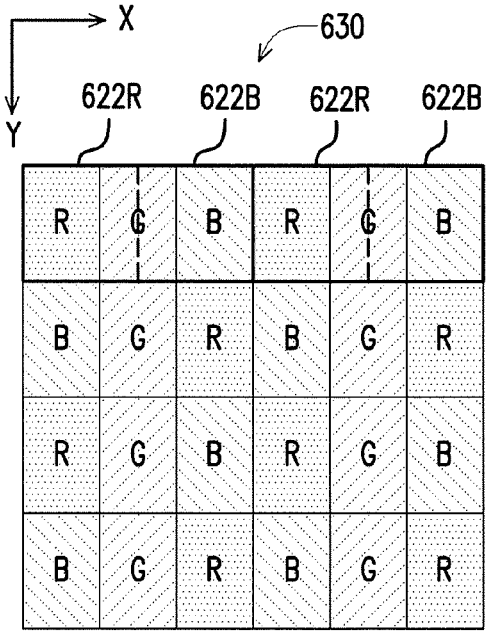

FIG. 11 is a schematic diagram illustrating parts of pixel data according another embodiment of the invention. FIG. 12 is a schematic diagram illustrating parts of the sub-pixels on the display panel according another embodiment of the invention. FIG. 13 is a schematic diagram illustrating a sub-pixel repeating unit according another embodiment of the invention. Referring to FIG. 11 to FIG. 13, a display panel 620 of the present embodiment is similar to the display panel 520 in the embodiment of FIG. 8, and a major difference between the two is that, for example, an arrangement of the sub-pixels on the display panel 620 and component elements of a sub-pixel repeating unit 630.

Specifically, in the present embodiment, the display panel 620 includes a plurality of sub-pixel combinations 622, which are composed of the first color sub-pixel, the second color sub-pixel and the third color sub-pixel adjacently arranged. Each of the sub-pixel combinations 622 includes two pixel units 622R and 622B. For instance, in the present embodiment, the sub-pixel combination 622 in which the red sub-pixel, the green sub-pixel and the blue sub-pixel are adjacently arranged includes, for example, the two pixel units 622R and 622B on the display panel 620. Because the pixel units 622R and 622B share three sub-pixels, each of the pixel units 622R and 622B includes one and half sub-pixel, and the pixel unit 622R includes one entire red sub-pixel and the pixel unit 622B includes one entire blue sub-pixel. The sub-pixel combinations 622 having three different colors are arranged on the display panel 620 in different directions to form a sub-pixel array. In the present embodiment, because the pixel data P11 and P12 are, for example, written into the same sub-pixel combination, the sub-pixel combination 622 includes two pixel widths (2WP) in the X direction.

In the present embodiment, parts of the sub-pixels of the display panel 620 are arranged into an array to form a sub-pixel repeating unit 630 of FIG. 13. The sub-pixel repeating unit 630 is repeatedly arranged to form the sub-pixel array of the display panel 620. In the present embodiment, the sub-pixel repeating unit 630 is, for example, a pixel array of 4×4 formed by arranging a plurality of the pixel units (622R, 622B) together. In the present embodiment, apart from the gamma voltages V0 and V255, the voltage output unit 320 further drives the sub-pixels on the display panel 620 by using, for example, a gamma voltage V186 in the second display mode. In the present embodiment, the gamma voltage V186 is, for example, determined according to a first quantity ratio in the X direction (the horizontal sub-pixel ratio) and a second quantity ratio in the Y direction (the vertical sub-pixel ratio) occupied by the pixel units (622R, 622B) in the sub-pixel repeating unit 630. For instance, take the red sub-pixel for example, in a first row of the sub-pixel repeating unit 630, in terms of quantity ratio, the pixel unit 622R has the first quantity ratio of 1/2 on the same row in the X direction. In other words, on the basis of pixel units, because the pixel unit 622R having the red sub-pixel occupies two over four of the pixel units (622R, 622B) of the first row, the first quantity ratio is 1/2. Because each row in the Y direction includes the pixel unit 622R, in terms of quantity ratio, the pixel unit 622R has the second quantity ratio of 1/1 in the Y direction. In other words, on the basis of pixel units, in the sub-pixel repeating unit 630, because each row includes the pixel units 622R having the red sub-pixel, the second quantity ratio is 1/1. Therefore, the ratio relationship determined according to the red sub-pixel is (1/2)/(1/1)=1/2. Similarly, the ratio relationships determined according to the blue sub-pixel and the green sub-pixel are both 1/2. In the present embodiment, the gamma voltage V186 is, for example, determined according to the ratio relationship of 1/2 together with a preset gamma voltage curve, and configured to drive the red, green and blue sub-pixels on the display panel 620.

After the voltage value of the gamma voltage V186 is determined according to the arrangement of the sub-pixels on the display panel 620, the voltage output unit 320 determines whether to drive a target driving sub-pixel by using the determined gamma voltage V186 according to an edge relationship between the target driving sub-pixel and a plurality of the sub-pixels adjacent thereto. In the present embodiment, the data processing unit 310 determines the edge relationship between the sub-pixels according to the most significant bit of the sub-pixel data written in the target driving sub-pixel and the sub-pixels adjacent thereto. In the present embodiment, sufficient teaching, suggestion, and implementation illustration regarding the method of the data processing unit 310 for determining the edge relationship between the sub-pixels may be obtained from the foregoing embodiments of FIG. 1 to FIG. 10, and thus related description thereof is not repeated hereinafter.

Figure 14:
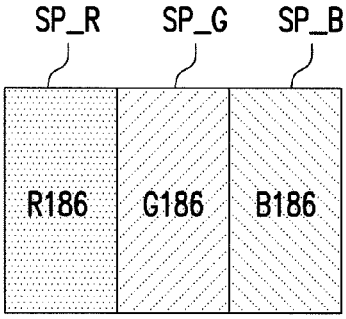

FIG. 14 is a schematic diagram illustrating a sub-pixel combination for displaying a white point according another embodiment of the invention. In the present embodiment, the display panel 620 displays one white point by using a sub-pixel combination including one red sub-pixel SP_R, one green sub-pixel SP_G and one blue sub-pixel SP_B, for example. In FIG. 14, "R186" marked inside the red sub-pixel SP_R indicates that the red sub-pixel SP_R is driven by the gamma voltage V186 and displays in red. "G186" marked inside the green sub-pixel SP_G indicates that the green sub-pixel SP_G is driven by the gamma voltage V186 and displays in green. "B186" marked inside the blue sub-pixel SP_B indicates that the blue sub-pixel SP_B is driven by the gamma voltage V186 and displays in blue. One red sub-pixel SP_R, one green sub-pixel SP_G and one blue sub-pixel SP_B cooperate to display one white point in the second display mode.

Figure 15:
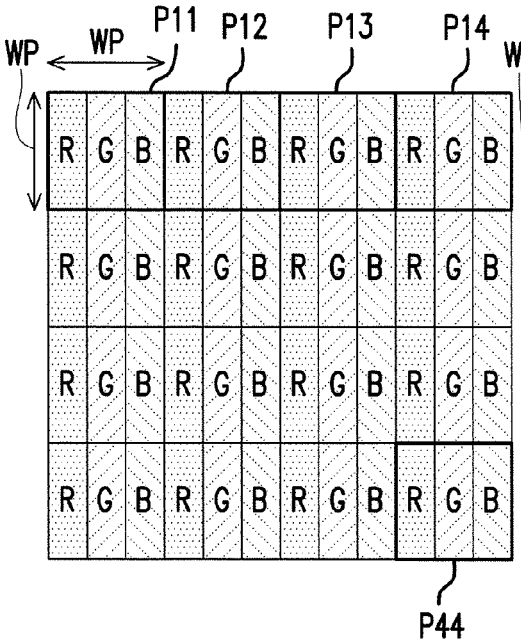
Figure 16:
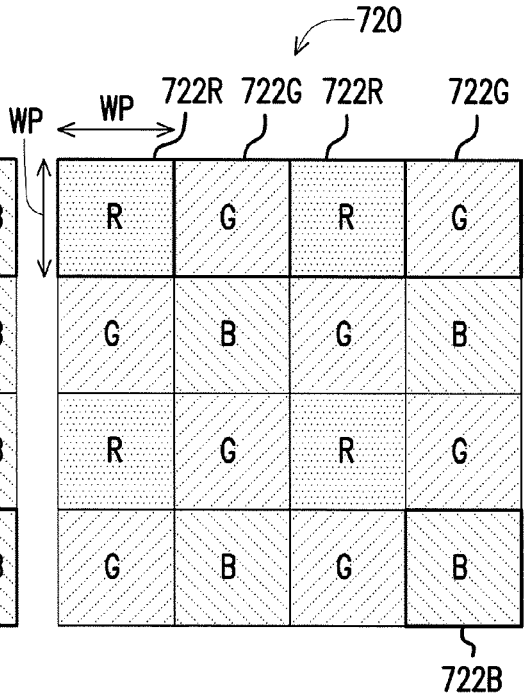
Figure 17:
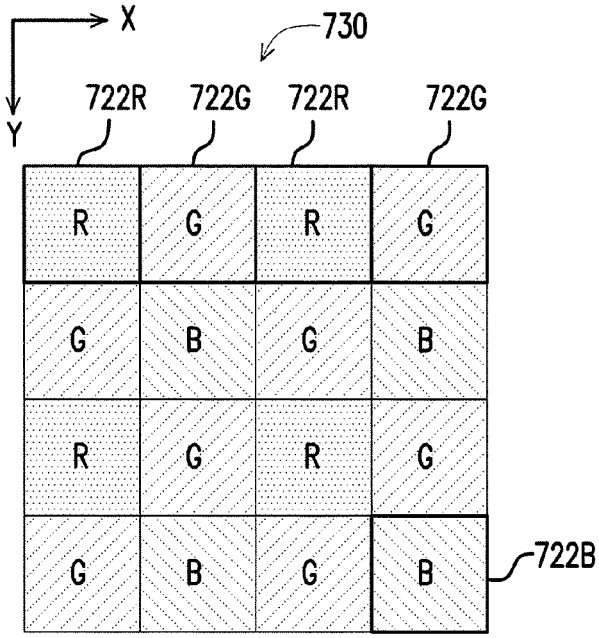

FIG. 15 is a schematic diagram illustrating parts of pixel data according another embodiment of the invention. FIG. 16 is a schematic diagram illustrating parts of the sub-pixels on the display panel according another embodiment of the invention. FIG. 17 is a schematic diagram illustrating a sub-pixel repeating unit according another embodiment of the invention. Referring to FIG. 15 to FIG. 17, a display panel 720 of the present embodiment is similar to the display panel 520 in the embodiment of FIG. 8, and a major difference between the two is that, for example, an arrangement of the sub-pixels on the display panel 720 and component elements of a sub-pixel repeating unit 730.

Specifically, in the present embodiment, the display panel 720 includes a plurality of pixel units (722R, 722G, 722B), and each of the pixel units (722R, 722G, 722B) includes one sub-pixel. For instance, in the present embodiment, the pixel unit 722R includes, for example, the red sub-pixel; the pixel unit 722B includes, for example, the blue sub-pixel; and the pixel unit 722G includes, for example, the green sub-pixel. The three pixel units 722R, 722G and 722B including the sub-pixels in different colors are arranged in staggered arrangement on the display panel 720 in different directions, so as to form a sub-pixel array. In the present embodiment, because the pixel data P11 is, for example, written into the sub-pixel 722R, the pixel data P11 and the sub-pixel 722R both include one pixel width (WP) in the X direction.

In the present embodiment, parts of the sub-pixels of the display panel 720 are arranged into an array to form a sub-pixel repeating unit 730 of FIG. 17. The sub-pixel repeating unit 730 is repeatedly arranged to form the sub-pixel array of the display panel 720. In the present embodiment, the sub-pixel repeating unit 730 is, for example, a pixel array of 4×4 formed by arranging a plurality of the pixel units (722R, 722G, 722B) together. In the present embodiment, apart from the gamma voltages V0 and V255, the voltage output unit 320 further drives the sub-pixels on the display panel 720 by using, for example, a gamma voltage V186 in the second display mode. In the present embodiment, the gamma voltage V186 is, for example, determined according to a first quantity ratio in the X direction (the horizontal sub-pixel ratio) and a second quantity ratio in the Y direction (the vertical sub-pixel ratio) occupied by the pixel units (722R, 722G, 722B) in the sub-pixel repeating unit 730. For instance, take the red sub-pixel for example, in a first row of the sub-pixel repeating unit 730, in terms of quantity ratio, the pixel unit 722R has the first quantity ratio of 1/2 on the same row in the X direction. In other words, on the basis of pixel units, because the pixel unit 722R having the red sub-pixel occupies two over four of the pixel units (722R, 722G, 722B) of the first row, the first quantity ratio is 1/2. Because the pixel unit 722R is included in rows at interval of one row to the other in the Y direction, in terms of quantity ratio, the pixel unit 722R has the second quantity ratio of 1/2 in the Y direction. In other words, on the basis of pixel units, in the sub-pixel repeating unit 730, because the pixel units 722R having the red sub-pixel is included in the rows at interval of one row to the other, the second quantity ratio is 1/2. Therefore, the ratio relationship determined according to the red sub-pixel is (1/2)/(1/2)=1. Similarly, the ratio relationship determined according to the blue sub-pixel is also 1. Further, in the present embodiment, take the green sub-pixel for example, in the sub-pixel repeating unit 730, the pixel unit 722G has the first quantity ratio of 1/2 on the same row in the X direction. Because each row in the Y direction includes the pixel unit 722G, the pixel unit 722G has the second quantity ratio of 1/1 in the Y direction. In other words, on the basis of pixel units, in the sub-pixel repeating unit 730, because each row includes the pixel units 722G having the green sub-pixel, the second quantity ratio is 1/1. Therefore, the ratio relationship determined according to the green sub-pixel is (1/2)/(1/1)=1/2. Therefore, in the present embodiment, the gamma voltage V186 is, for example, determined according to the ratio relationship of 1/2 together with a preset gamma voltage curve, and configured to drive the green sub-pixels on the display panel 720. In addition, in the present embodiment, the red and blue sub-pixels are, for example, driven by the gamma voltage V0 or V255.

After the voltage value of the gamma voltage V186 is determined according to the arrangement of the sub-pixels on the display panel 720, the voltage output unit 320 determines whether to drive a target driving sub-pixel by using the determined gamma voltage V186 according to an edge relationship between the target driving sub-pixel and a plurality of the sub-pixels adjacent thereto. In the present embodiment, the data processing unit 310 determines the edge relationship between the sub-pixels according to the most significant bit of the sub-pixel data written in the target driving sub-pixel and the sub-pixels adjacent thereto. In the present embodiment, sufficient teaching, suggestion, and implementation illustration regarding the method of the data processing unit 310 for determining the edge relationship between the sub-pixels may be obtained from the foregoing embodiments of FIG. 1 to FIG. 10, and thus related description thereof is not repeated hereinafter.

Figure 18:
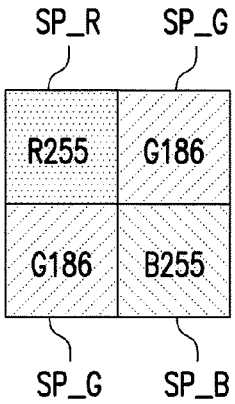

FIG. 18 is a schematic diagram illustrating a sub-pixel combination for displaying a white point according another embodiment of the invention. In the present embodiment, the display panel 720 displays one white point by using a sub-pixel combination including one red sub-pixel SP_R, two green sub-pixels SP_G and one blue sub-pixel SP_B, for example. In FIG. 18, "R255" marked inside the red sub-pixel SP_R indicates that the red sub-pixel SP_R is driven by the gamma voltage V255 and displays in red. "G186" marked inside the green sub-pixel SP_G indicates that the green sub-pixel SP_G is driven by the gamma voltage V186 and displays in green. "B255" marked inside the blue sub-pixel SP_B indicates that the blue sub-pixel SP_B is driven by the gamma voltage V255 and displays in blue. In the present embodiment, one red sub-pixel SP_R, two green sub-pixels SP_G and one blue sub-pixel SP_B cooperate to display one white point in the second display mode.

Figure 19:
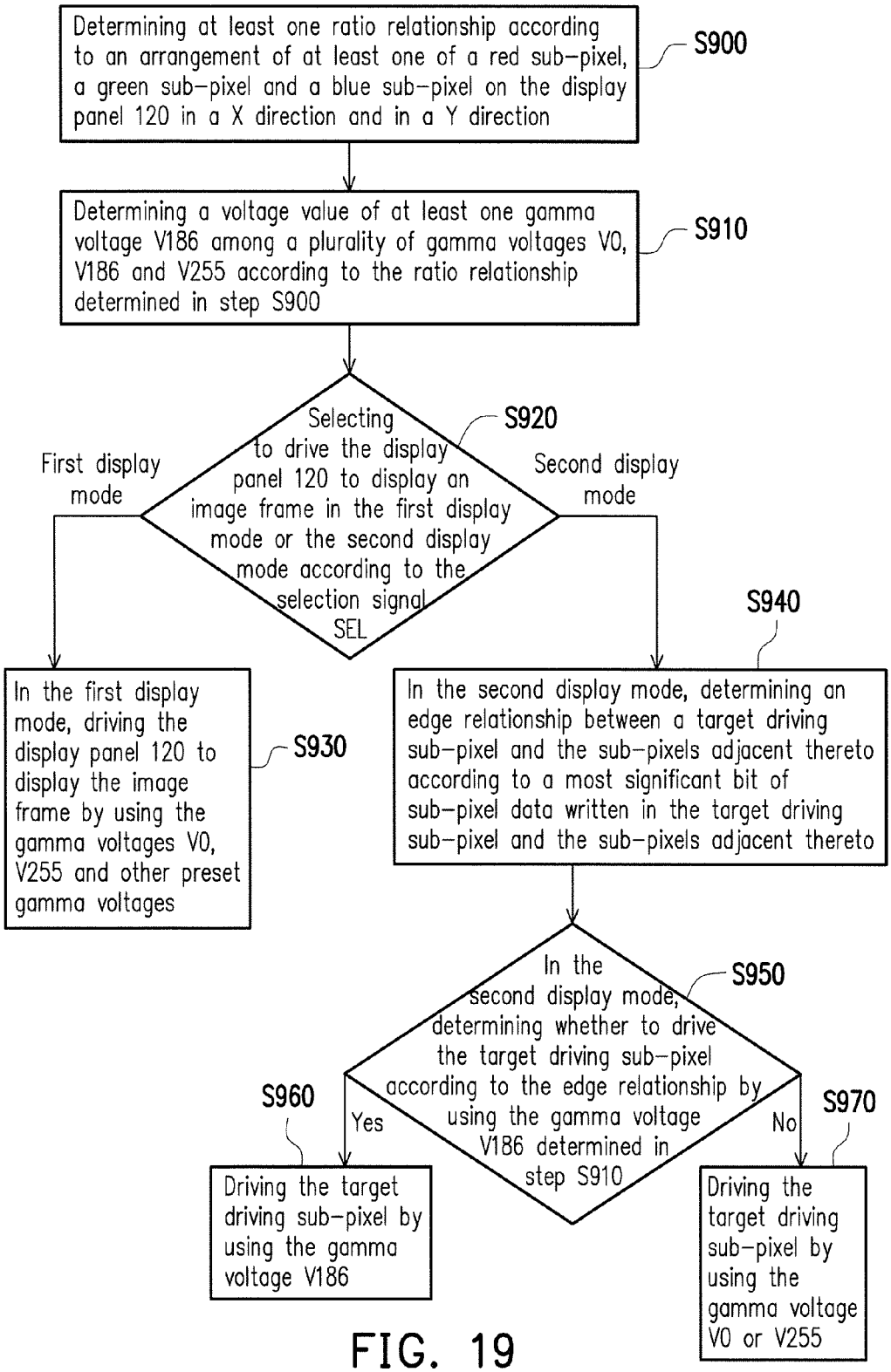
FIG. 19 is a flowchart illustrating a display driving method according to an embodiment of the invention.

FIG. 19 is a flowchart illustrating a display driving method according to an embodiment of the invention. The display driving method is, for example, at least applied in the display apparatus 100 of FIG. 1. The display driving method includes the following steps. In step S900, at least one ratio relationship related to an arrangement of sub-pixels on the display panel 120 is determined according to an arrangement of at least one of a red sub-pixel, a green sub-pixel and a blue sub-pixel on the display panel 120 in a X direction and in a Y direction. Next, in step S910, a voltage value of at least one gamma voltage V186 among a plurality of gamma voltages V0, V186 and V255 is determined according to the ratio relationship determined in step S900. Thereafter, in step S920, the display driver 110 selects to drive the display panel 120 to display an image frame in the first display mode or the second display mode by using the first display driving channel 112 or the second display driving channel 114 according to the selection signal SEL.

In step S920, if the display driver 110 selects to drive the display panel 120 to display the image frame by using the first display driving channel 112 in the first display mode according to the selection signal SEL, the display driving method proceeds to execute step S930. In step S930, in the first display mode, the first display driving channel 112 drives the display panel 120 to display the image frame by using the gamma voltages V0, V255 and other preset gamma voltages.

In step S920, if the display driver 110 selects to drive the display panel 120 to display the image frame by using the second display driving channel 114 in the second display mode according to the selection signal SEL, the display driving method proceeds to execute step S940. In step S940, in the second display mode, the second display driving channel 114 determines an edge relationship between a target driving sub-pixel and the sub-pixels adjacent thereto according to a most significant bit of sub-pixel data written in the target driving sub-pixel and the sub-pixels adjacent thereto. Next, in step S950, in the second display mode, the second display driving channel 114 determines whether to drive the target driving sub-pixel by using the gamma voltage V186 determined in step S910 according to the edge relationship.

In step S950, if the second display driving channel 114 determines to drive the target driving sub-pixel by using the gamma voltage V186, the display driving method proceeds to execute step S960. In step S960, the second display driving channel 114 drives the target driving sub-pixel by using the gamma voltage V186. In step S950, if the second display driving channel 114 determines not to drive the target driving sub-pixel by using the gamma voltage V186, the display driving method proceeds to execute step S970. In step S970, the second display driving channel 114 drives the target driving sub-pixel by using the gamma voltage V0 or V255.

In addition, sufficient teaching, suggestion, and implementation illustration regarding the display driving method of the embodiments of the invention may be obtained from the above embodiments depicted in FIG. 1 to FIG. 18, and thus related description thereof is not repeated hereinafter.

In summary, in the exemplary embodiments of the invention, a voltage value of at least one gamma voltage among a plurality of gamma voltages for driving a display panel is determined according to a ratio relationship, and such ratio relationship is determined according to an arrangement of sub-pixels in different colors on the display panel in different directions. In a second display mode, a display driver according to the exemplary embodiments of the invention determines whether to drive the display panel by using the determined gamma voltage according to an edge relationship between the sub-pixels in a second display mode, so as to take into account both display quality and power-saving.

Although the present disclosure has been described with reference to the above embodiments, it will be apparent to one of ordinary skill in the art that modifications to the described embodiments may be made without departing from the spirit of the disclosure. Accordingly, the scope of the disclosure will be defined by the attached claims and not by the above detailed descriptions.

What is claimed is:

1. A display driver, configured to drive a display panel, wherein the display panel is configured to display an image frame in a first display mode or a second display mode, and the display driver comprises:

a first display driving channel, driving the display panel to display the image frame by using a sub-pixel rendering method in the first display mode; and a second display driving channel, driving the display panel to display the image frame by using the sub-pixel rendering method in the second display mode, wherein the display panel comprises a sub-pixel repeating unit, the sub-pixel repeating unit is repeatedly arranged to form the display panel, the sub-pixel repeating unit comprises a plurality of pixel units, and each of the pixel units comprises one to two sub-pixels, wherein in the second display mode, the second display driving channel drives the sub-pixels on the display panel to display corresponding grayscales by using a plurality of gamma voltages, and a voltage value of at least one gamma voltage among the gamma voltages is determined according to at least one ratio relationship, wherein the at least one ratio relationship is determined according to at least one of quantity ratios occupied by at least one of the sub-pixels in the sub-pixel repeating unit.

2. The display driver according to claim 1, wherein in the display panel, each of the pixel units comprises at least one of a first color sub-pixel, a second color sub-pixel and a third color sub-pixel, and the at least one ratio relationship is determined according to a first quantity ratio in a first direction and a second quantity ratio in a second direction occupied by the at least one of the first color sub-pixel, the second color sub-pixel and the third color sub-pixel in the sub-pixel repeating unit, on the basis of pixel units.

3. The display driver according to claim 2, wherein in the display panel, the pixel units comprise a first pixel unit and a second pixel unit, the first color sub-pixel and the second color sub-pixel are adjacently arranged to form the first pixel unit, and the third color sub-pixel and the second color sub-pixel are adjacently arranged to form the second pixel unit.

4. The display driver according to claim 2, wherein in the display panel, the pixel units comprise a first pixel unit, a second pixel unit and a third pixel unit, the first color sub-pixel and the second color sub-pixel are adjacently arranged to form the first pixel unit, the third color sub-pixel and the second color sub-pixel are adjacently arranged to form the second pixel unit, and the first color sub-pixel and the third color sub-pixel are adjacently arranged to form the third pixel unit.

5. The display driver according to claim 2, wherein in the display panel, the first color sub-pixel, the second color sub-pixel and the third color sub-pixel are adjacently arranged to form two pixel units among the pixel units.

6. The display driver according to claim 2, wherein in the display panel, each of the pixel units comprises a single sub-pixel, and the single sub-pixel comprises the first color sub-pixel, the second color sub-pixel or the third color sub-pixel.

7. The display driver according to claim 2, wherein in the display panel, the first color sub-pixel, the second color sub-pixel and the third color sub-pixel are a red sub-pixel, a green sub-pixel and a blue sub-pixel respectively.

8. The display driver according to claim 1, wherein the sub-pixels comprise a target driving sub-pixel, and the second display driving channel determines whether to drive the target driving sub-pixel by using the at least one determined gamma voltage according to an edge relationship between the target driving sub-pixel and a plurality of the sub-pixels adjacent thereto in the second display mode.

9. The display driver according to claim 8, wherein the second display driving channel determines the edge relationship according to a most significant bit of sub-pixel data written in the target driving sub-pixel and the sub-pixels adjacent thereto.

10. The display driver according to claim 9, wherein the second display driving channel comprises:

a data processing unit, configured to determine the edge relationship according to the most significant bit of the sub-pixel data written in the target driving sub-pixel and the sub-pixels adjacent thereto; and a voltage output unit, determining whether to drive the target driving sub-pixel by using the at least one determined gamma voltage according to the edge relationship between the target driving sub-pixel and the sub-pixels adjacent thereto.

11. The display driver according to claim 1, wherein the gamma voltages comprise a first gamma voltage, a second gamma voltage and a third gamma voltage, and a voltage value of the third gamma voltage is determined according to the arrangement of the sub-pixels on the display panel, wherein a voltage value of the first gamma voltage is less than a voltage value of the second gamma voltage, and the voltage value of the third gamma voltage falls between the voltage values of the first gamma voltage and the second gamma voltage.

12. The display driver according to claim 11, wherein the gamma voltages further comprise a fourth gamma voltage, and a voltage value of the fourth gamma voltage is further determined according to the arrangement of the sub-pixels on the display panel, wherein the voltage value of the fourth gamma voltage falls between the voltage values of the first gamma voltage and the third gamma voltage.

13. The display driver according to claim 11, further comprising:

a selection unit, selecting to drive the display panel to display the image frame in the first display mode or the second display mode by using the first display driving channel or the second display driving channel according to a selection signal.

14. A display apparatus, comprising:

a display panel, comprising a sub-pixel repeating unit, the sub-pixel repeating unit being repeatedly arranged to form the display panel, the sub-pixel repeating unit comprising a plurality of pixel units, each of the pixel units comprising one to two sub-pixels, and the display panel being configured to display an image frame in a first display mode or a second display mode; and a display driver, coupled to the display panel, comprising a first display driving channel and a second display driving channel, and configured to drive the display panel to display the image frame by using a sub-pixel rendering method, wherein in the second display mode, the second display driving channel drives the sub-pixels on the display panel to display corresponding grayscales by using a plurality of gamma voltages, and a voltage value of at least one gamma voltage among the gamma voltages is determined according to at least one ratio relationship, wherein the at least one ratio relationship is determined according to at least one of quantity ratios occupied by at least one of the sub-pixels in the sub-pixel repeating unit.

15. The display apparatus according to claim 14, wherein in the display panel, each of the pixel units comprises at least one of a first color sub-pixel, a second color sub-pixel and a third color sub-pixel, and the at least one ratio relationship is determined according to a ratio in a first direction and a ratio in a second direction occupied by the at least one of the first color sub-pixel, the second color sub-pixel and the third color sub-pixel in the sub-pixel repeating unit.

16. The display apparatus according to claim 15, wherein in the display panel, the pixel units comprise a first pixel unit and a second pixel unit, the first color sub-pixel and the second color sub-pixel are adjacently arranged to form the first pixel unit, and the third color sub-pixel and the second color sub-pixel are adjacently arranged to form the second pixel unit.

17. The display apparatus according to claim 15, wherein in the display panel, the pixel units comprise a first pixel unit, a second pixel unit and a third pixel unit, the first color sub-pixel and the second color sub-pixel are adjacently arranged to form the first pixel unit, the third color sub-pixel and the second color sub-pixel are adjacently arranged to form the second pixel unit, and the first color sub-pixel and the third color sub-pixel are adjacently arranged to form the third pixel unit.

18. The display apparatus according to claim 15, wherein in the display panel, the first color sub-pixel, the second color sub-pixel and the third color sub-pixel are adjacently arranged to form two pixel units among the pixel units.

19. The display apparatus according to claim 15, wherein in the display panel, each of the pixel units comprises a single sub-pixel, and the single sub-pixel comprises the first color sub-pixel, the second color sub-pixel or the third color sub-pixel.

20. The display apparatus according to claim 15, wherein in the display panel, the first color sub-pixel, the second color sub-pixel and the third color sub-pixel are a red sub-pixel, a green sub-pixel and a blue sub-pixel respectively.

21. The display apparatus according to claim 14, wherein the sub-pixels comprise a target driving sub-pixel, and the second display driving channel determines whether to drive the target driving sub-pixel by using the at least one determined gamma voltage according to an edge relationship between the target driving sub-pixel and a plurality of the sub-pixels adjacent thereto in the second display mode.

22. The display apparatus according to claim 21, wherein the second display driving channel determines the edge relationship according to a most significant bit of sub-pixel data written in the target driving sub-pixel and the sub-pixels adjacent thereto.

23. The display apparatus according to claim 22, wherein the second display driving channel comprises:

a data processing unit, configured to determine the edge relationship according to the most significant bit of the sub-pixel data written in the target driving sub-pixel and the sub-pixels adjacent thereto; and a voltage output unit, coupled to the data processing unit, and configured to determine whether to drive the target driving sub-pixel by using the at least one determined gamma voltage according to the edge relationship between the target driving sub-pixel and the sub-pixels adjacent thereto.

24. The display apparatus according to claim 14, wherein the gamma voltages comprise a first gamma voltage, a second gamma voltage and a third gamma voltage, and a voltage value of the third gamma voltage is determined according to the arrangement of the sub-pixels on the display panel, wherein a voltage value of the first gamma voltage is less than a voltage value of the second gamma voltage, and the voltage value of the third gamma voltage falls between the voltage values of the first gamma voltage and the second gamma voltage.

25. The display apparatus according to claim 24, wherein the gamma voltages further comprise a fourth gamma voltage, and a voltage value of the fourth gamma voltage is further determined according to the arrangement of the sub-pixels on the display panel, wherein the voltage value of the fourth gamma voltage falls between the voltage values of the first gamma voltage and the third gamma voltage.

26. The display apparatus according to claim 25, wherein the display driver further comprises:

a selection unit, selecting to drive the display panel to display the image frame in the first display mode or the second display mode by using the first display driving channel or the second display driving channel according to a selection signal.

* * * * *